United States Patent [19]

Barber et al.

[11] 4,116,409

[45] Sep. 26, 1978

[54] HYDRAULIC LEVELLING SYSTEMS FOR DRILLING MACHINES, ETC.

[75] Inventors: Antony Dobson Barber, Truro; Zdenek Fisher, Porthleven, both of England

[73] Assignee: Compair Construction and Mining Limited, Cambourne, England

[21] Appl. No.: 701,803

[22] Filed: Jul. 1, 1976

[51] Int. Cl.[2] ..... E21C 11/00; E21C 5/08

[52] U.S. Cl. ..... 248/2; 173/43

[58] Field of Search ..... 248/2, 16; 173/2, 43, 173/38; 212/55; 182/2; 91/190

[56] References Cited

U.S. PATENT DOCUMENTS

| | | | |
|---|---|---|---|
| 3,082,842 | 3/1963 | Balogh | 182/2 |
| 3,100,025 | 8/1963 | Shennum | 182/2 |
| 3,374,975 | 3/1968 | Bronder | 248/15 |
| 3,462,103 | 8/1969 | Strom | 173/43 X |
| 3,481,409 | 12/1969 | Westerlund | 248/16 X |
| 3,547,072 | 12/1970 | Birbanescv | 182/2 X |
| 3,590,930 | 7/1971 | Gronfors | 173/38 X |
| 3,616,940 | 11/1971 | Milner | 182/2 X |
| 3,721,304 | 3/1973 | Hanson | 173/2 |
| 3,791,460 | 2/1974 | Tkachenko | 173/43 |
| 3,896,885 | 7/1975 | Dahlstrom | 248/2 X |
| 3,980,142 | 9/1976 | Grigoriev | 248/16 X |

FOREIGN PATENT DOCUMENTS

| | | | |
|---|---|---|---|
| 886,975 | 11/1971 | Canada | 248/16 |
| 2,250,405 | 10/1972 | Fed. Rep. Germany | 173/2 |
| 115,050 | 7/1968 | Norway | 248/2 |
| 7,309,392 | 2/1975 | Sweden | 248/2 |
| 301,434 | 6/1972 | U.S.S.R. | 173/2 |

*Primary Examiner*—J. Franklin Foss

*Attorney, Agent, or Firm*—Watson, Cole, Grindle & Watson

[57] ABSTRACT

A drilling machine has a drill carriage pivotally mounted on the upper end of a jib whose lower end is pivoted to a support structure. To maintain the drill carriage in parallelism as the jib pivots, two hydraulically interconnected hydraulic jacks are provided, namely a slave jack pivotally connected between the jib and support structure to form a first triangle with its corners at the pivot point of the jib and the two pivot connections of the jack; and a follower jack pivotally connected between the jib and the drill carriage to form a second triangle with corners at the drill carriage pivot point and the two pivot connections of the follower jack. These two triangles are similar triangles. The full-bore end of one of the jacks is connected by a closed hydraulic line to the annular end of the other jack, and the other ends of the two jacks are interconnected by a second hydraulic line provided with, for example, a hydraulic accumulator for accommodating any excess fluid displaced by the interlinked movement of the jacks when the jib moves pivotally. To ensure that the carriage maintains strict parallelism as the jib moves, the ratio of the effective cross-sectional areas of the ends of the two jacks between which the first closed hydraulic line is connected is made to equal the ratio of similarity of the two triangles.

15 Claims, 14 Drawing Figures

HYDRAULIC LEVELLING SYSTEMS FOR DRILLING MACHINES, ETC.

BACKGROUND OF THE INVENTION

This invention relates to hydraulic levelling systems for controlling and maintaining substantially constant the orientation of a member pivoted to the outer end of a movable jib, for example, the jib-mounted drill carriage of a rock drilling machine.

DESCRIPTION OF THE PRIOR ART

When a drilling machine of the kind having a rotary rock drill mounted in a carriage which is pivotally supported by a swinging and swivelling jib is used to drill multiple holes in a rock face, it is required to maintain the orientation of the drill carriage and drill substantially unaltered as the jib is moved to transfer the drill from one hole position to the next, so that the axes of the drilled holes shall be substantially parallel. For this purpose parallel-motion mechanical linkages have been employed to control the orientation of the drill carriage.

It has also been proposed to provide a hydraulic levelling system comprising a pair of hydraulically-interconnected hydraulic jacks, one pivotally connected between the jib and a fixed support and the other pivotally connected between the jib and the drill carriage or other structure pivoted to the jib, to control the orientation of the drill carriage or other pivoted structure as the jib swings or swivels.

An object of the invention is to provide an improved hydraulic levelling system in which the orientation of the member pivotally supported by the jib can be maintained more accurately in parallelism as the jib moves than in the known system.

According to the present invention, a supporting mechanism for a rotary rock drill or other tool or structure comprises a jib pivoted at or near its inner end to a support structure, for example a vehicle, and a drill carriage or other support member pivotally mounted on the outer end of the jib to be supported thereby. The mechanism includes a hydraulic levelling system for the drill carriage or other support member comprising a pair of hydraulically-interconnected linearly expansible and contractible hydraulic jacks, one being pivotally connected between the jib and its support structure to sense angular movement of the jib relative to the support structure about the axis of the pivotal connection of the jib thereto, and the other being pivotally connected between the jib and the support member to control the orientation of the supported member. The levelling system is so constructed and arranged that the triangle whose corners are respectively constituted by the pivotal connection point of the first jack to the support structure, the pivotal connection point of the jib to the support structure, and the pivotal connection point of the first jack to the jib, is similar to the triangle whose corners are respectively constituted by the pivotal connection point of the second jack to the supported member, the pivotal connection point of the jib to the supported member and the pivotal connection point of the second jack to the jib. According to the invention, with angular movement of the jib relative to the support structure, the ratio of the corresponding changes in length of the hydraulic jacks equals the ratio of similarity of the triangles, whereby the support member is maintained in parallelism.

The jacks are preferably of the double-acting kind whose cylinder has a closed full-bore end and is of lesser effective cross-section at the other end, referred to as the annular end, through which the jack plunger rod extends. The annular end of one jack (either the first or the second jack) may be hydraulically connected to the full-bore end of the other jack by a first hydraulic connection, which is or can be closed, and whenever fluid is displaced from one jack to the other, an equal volume of fluid is displaced. In fact the ratio between the effective cross-sectional areas of the ends of the first and second jacks to which the first hydraulic connection is made are equal to the ratio of similarity of the triangles. The similar triangles will be equal in the case where the effective cross-sectional area of the annular end of the one jack equals that of the full-bore end of the other jack. Means are provided for keeping the first hydraulic connection under positive hydraulic pressure.

In such arrangements, a second hydraulic connection may be provided between the annular end of the other jack and the full-bore end of the one jack, with means for accommodating excess hydraulic fluid displaced by movement of the jib.

The means for accommodating excess displaced hydraulic fluid may comprise a hydraulic accumulator, which may also serve to maintain positive pressure in the wholly-closed hydraulic connection.

Again, the means for accommodating excess displaced hydraulic fluid and maintaining positive pressure may comprise a connection to a hydraulic pump circuit in combination with a pressure limiting valve; or a third, free-running double-acting hydraulic jack connected between the annular end of the said other jack and the full-bore end of the said one jack, the ratio between the effective areas of the opposite ends of the third jack being such as to compensate for the excess fluid displacement.

In a construction in which the jib is provided with a hydraulic jack, referred to as the driving jack, for effecting the pivotal movement of the jib about its pivotal connection to the support structure, the connection to the pump delivery circuit may comprise a control valve which is selectively operable to connect the driving jack selectively to the pump delivery circuit and cause it to pivot the jib in either direction, and the control valve when so operated may also connect the second hydraulic connection to the pump delivery circuit to provide the means for accommodating excess displaced fluid.

In this case the means for keeping the first hydraulic connection under positive hydraulic pressure may comprise a pilot-operated check valve connected in the second hydraulic connection and responsive to the hydraulic pressure in the first hydraulic connection.

Alternatively, however, the first jack may also be used as a driving jack for effecting the pivotal movement of the jib in either sense about its connection to the support structure.

In the case where, as in a drilling machine, the jib is required to be swung angularly up and down about a horizontal pivotal axis remote from the support member, and also to be slewed from side to side about a vertical pivot axis remote from the support member, the machine is provided with two separate hydraulic levelling systems as described, respectively controlling the orientation of the support member as the jib swings up and down, and as it slews.

DESCRIPTION OF THE DRAWINGS

The invention may be carried into practice in various ways, but certain specific embodiments will now be described by way of example with reference to the accompanying drawings, in which.

DESCRIPTION OF THE PREFERRED EMBODIMENTS

Figure 1:
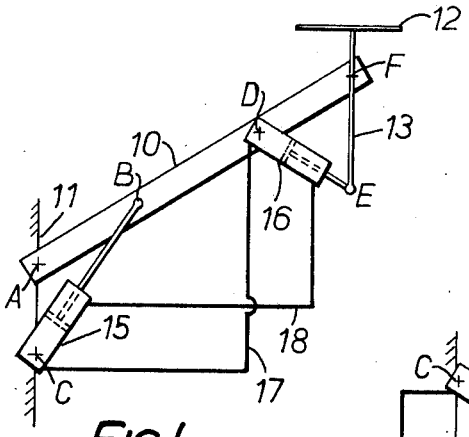
FIG. 1. PRIOR ART
FIG. 1 is a diagram indicating elements of known hydraulic levelling systems used for mounting a jib-mounted drill carriage.

FIG. 1 shows diagrammatically elements of known hydraulic leveling systems, herein depicted showing a drilling machine having a jib 10 whose inner and lower end is pivoted at A about a horizontal axis to a supporting structure 11, which may be, for example, a self-propelled vehicle, the jib having a driving, or lifting jack (not shown) by which it can be moved pivotally up and down in a vertical plane. A drill carriage or support seat 12 is mounted on an upright support member 13 pivoted at F about a horizontal axis parallel to the pivotal axis of the jib at A, adjacent to the outer end of the jib.

A pair of hydraulic jacks 15 and 16 interconnected hydraulically by pipelines 17, 18 constitute a levelling system for the drill carriage or support seat 12. Both jacks are of the kind having a plunger rod extending through one end only of the jack cylinder, the other end of the cylinder being closed. The first jack 15 is pivoted at C to the supporting structure 11 at a point vertically below the pivot point A of the jib, and its plunger is pivotally connected at B to a point in the length of the jib spaced from the pivot A. The second jack 16 is pivoted at D to the jib at a point in the length of the latter between the pivot points B and F. The plunger rod of the second jack 16 is pivoted at E to the lower end of the support member 13 for the drill carriage or support seat 12. The axes of all the pivots at A, B, C, D, E and F are horizontal and transverse to the jib 10.

The full-bore ends of the two jacks 15 and 16 are interconnected by the pipeline 17, and the opposite ends of annular effective cross-section (referred to as the annular ends) are interconnected by the pipeline 18, thus forming a closed hydraulic system. The two jacks 15 and 16 are of equal cross areas both at their full-bore ends and at their annular ends so that a given linear extension of the first jack 15 displaces a quantity of hydraulic fluid sufficient to produce an equal linear contraction of the other jack 16.

The jack 15 thus senses angular movements of the jib 10 and transmits corresponding displacement signals to the jack 16, whose resultant change in length tends to tilt the drill carriage or support seat 12 and support member 13 in a direction to compensate for the change in angle of the jib 10, thus tending to keep the orientation of the drill carriage or support seat 12 constant. However, it will be noted that the triangles CAB and EFD are not similar triangles, so that the mechanism does not result in movements in strict parallelism of the drill carriage 12, but only in an approximation thereto.

Figure 2:
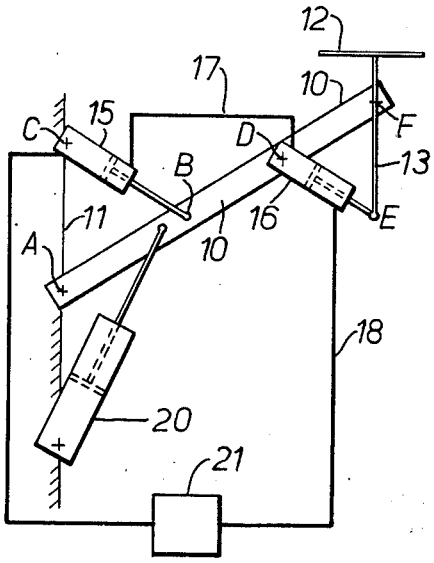
FIGS. 2 to 8 are diagrams of eight different levelling systems embodying the present invention.

FIG. 2 shows an embodiment of a drilling machine according to the present invention, in which similar parts are given the same reference letters and numerals as in FIG. 1, and in which a lifting jack 20 is also shown. In FIG. 2, not only are the two jacks 15 and 16 arranged parallel to one another, but also the two triangles CAB and EFD are similar triangles. Moreover, the annular end of the first jack 15 is connected to the full-bore end of the second jack 16 by the hydraulic connection 17 which forms a closed connection, and the annular end of the second jack 16 is connected to the full-bore end of the first jack 15 through an accommodation device indicated by the rectangle 21.

In the system shown in FIG. 2, a raising of the jib 10 about the pivot A will produce a contraction of the first jack 15, which will displace a certain amount of fluid through the line 17 from the full-bore end of the second jack 15. The ratio of the effective cross-sectional area of the annular end of the jack 15 to the effective cross-sectional area of the full-bore end of the jack 16 is chosen to be equal to the ratio of similarity of the triangles EFD and CAB, e.g.

DE/CB so that the contraction of the second jack 16 produced by a given contraction of the first jack 15 will be in the same ratio DE/AB. This ensures that the two triangles CAB and EFD remain similar, and in particular that the angle CAB will remain equal to the angle EFD, despite angular movement of the jib, and that the orientation of the drill carriage or support seat 12 is unaltered by such movements, i.e., strict parallelism of movement of the drill carriage 12 is produced.

However, since the ratio of the full-bore end area of the first jack 15 to the annular end area of the second jack 16 is not equal to the ratio DE/CB, there will be an excess of displaced fluid produced by the raising of the jib 10, i.e., a net discharge of fluid, so that it is not possible for the full-bore end of the jack 15 to be directly connected to the annular end of the jack 16. Instead, some means has to be provided in the line 18 for accommodating this net discharge when the jib is raised, and delivering it again when the jib is lowered. According to FIG. 2 this means is shown diagrammatically by the rectangle 21. In addition, steps must be taken to ensure that there is a positive hydraulic pressure at all times in the hydraulic circuit 15, 17, 16, 18, so as to avoid cavitation in the line 17 and loss of parallel motion.

Figure 2A:
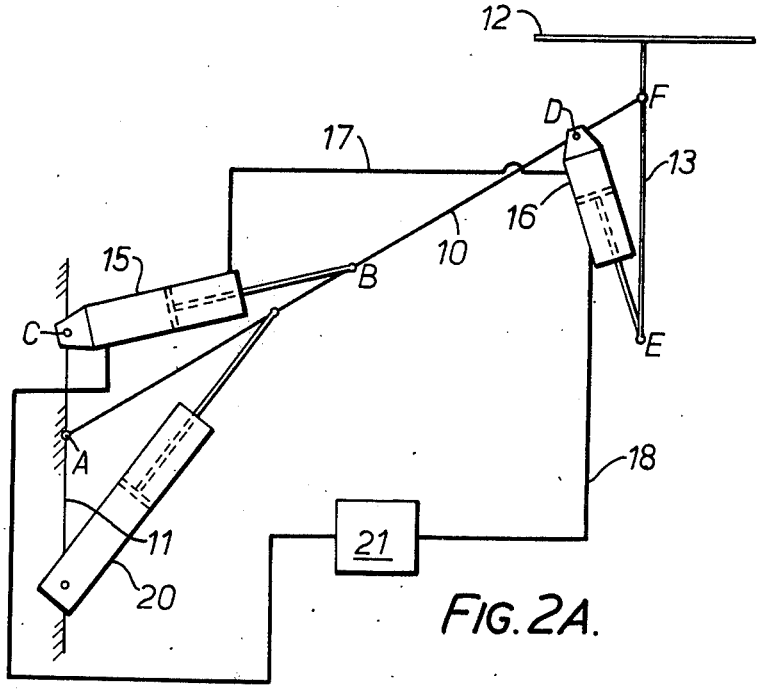

FIG. 2A shows a modification of the circuit of FIG. 2 in which the jacks 15 and 16 are not maintained parallel, although the triangles CAB and DFE are similar triangles, and although the essential condition that the angle CAB shall always be equal to the angle DFE is maintained.

Whereas in FIG. 2, $$\frac{DF}{AB} = \frac{FE}{AC} = \frac{DE}{CB} = \text{a constant (the ratio of similarity)},$$

in FIG. 2A

$$\frac{FE}{AB} = \frac{DF}{AC} = \frac{DE}{CB} = \text{a constant (the ratio of similarity).}$$

Either of the configurations of FIGS. 2 and 2A may be chosen, depending upon whichever is the more convenient for ram assembly in a particular case.

Figure 3:
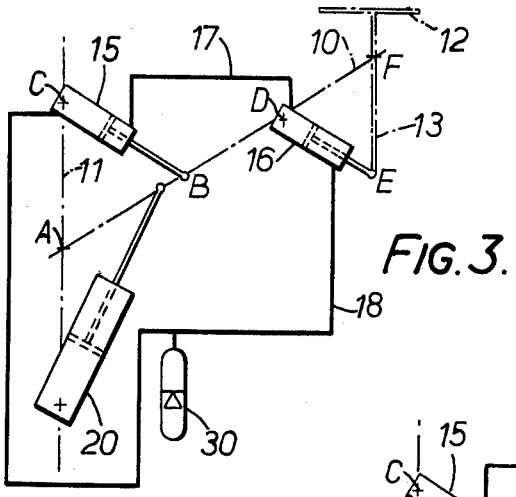

FIG. 3 shows one arrangement of the circuit of FIG. 2 in which the device 21 for accommodating the excess discharge comprises a hydraulic accumulator 30 connected in the line 18. The accumulator 30 also serves to keep a positive pressure in the system at all times.

There will be a certain external load on the second jack 16 caused by the weight of the drill and any other eccentrically-mounted parts. If this load is represented by P and is assumed to act in the direction such as to extend the jack 16, and if $p_1$ = pressure in closed hydraulic link 17

$p_2$ = pressure in other hydraulic link 18

Then $P = p_2 \times A_4 - p_1 \times A_3$ or $$p_2 = \frac{P + p_1 \times A_3}{A_4}$$

Where $A_3$ = area of full-bore end of jack 16

$A_4$ = area of annular end of jack 16.

If $p_1$ is not to fall to zero or become negative, $p_2$ must always be in excess of $P/A_4$. The extent of this excess is unimportant since it will merely increase $p_1$.

The load in the jack 15 $= p_2 \times A_1 - p_1 \times A_2$ where $A_1$ = area of full-bore end of jack 15 and $A_2$ = area of annular end of jack 15 and this load has to be resisted by the lifting jack 20.

Thus the accumulator 30 must be designed so that for all geometric configurations of the jib and jacks, and for all loads, $p_2$ is always greater than $P/A_4$. This criterion is easily achieved since P is usually small.

Figure 4:
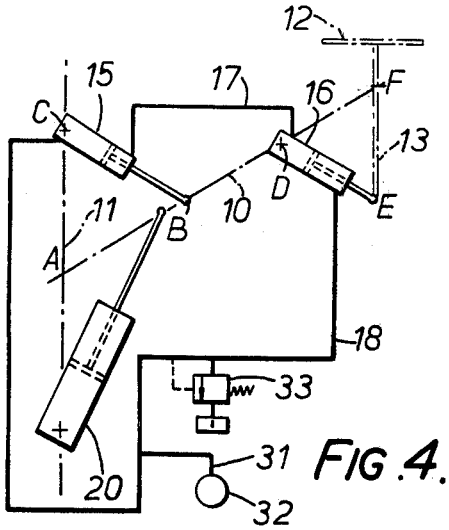

FIG. 4 shows another arrangement of the circuit of FIG. 2 in which the device 21 comprises a permanent connection 31 to the delivery of a hydraulic pump 32, together with a pressure limiting valve 33 set to maintain the desired positive pressure in the closed line 17. The valve 33 allows the excess fluid discharged to escape from the system on the raising of the jib, whilst the delivery from the pump makes up the required balance of fluid in the system when the jib is lowered by the jack 20.

Figure 5:
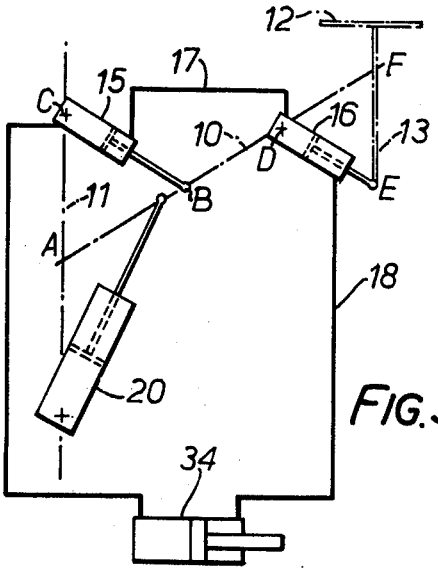

FIG. 5 shows another arrangement of the hydraulic circuit of FIG. 2 in which the device 21 takes the form of an additional jack 34 connected in the hydraulic line 18 with its full-bore end connected to the full-bore end of the jack 15 and its annular end connected to the annular end of the jack 16.

$$\text{The ratio } \frac{\text{Area of Full-bore end of Jack 34}}{\text{Area of Annular end of Jack 34}} = \frac{\text{Area of Full-bore end of Jack 15}}{\text{Area of Annular end of Jack 15}} \times \frac{\text{Area of Full-bore end of Jack 16}}{\text{Area of Annular end of Jack 16}}.$$

The jack 34 thus serves as a free-running dummy ram whose piston moves to accommodate and deliver the excess fluid on upward and downward movement of the jib.

Figure 6:
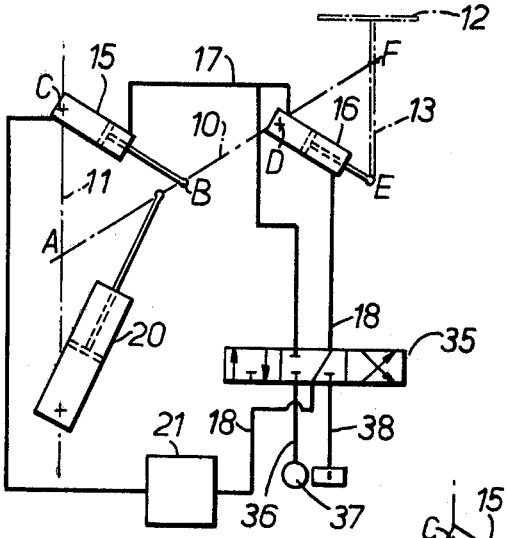

FIG. 6 shows another arrangement of the system of FIG. 2 in which it is possible to actuate the second jack 16 as a dump ram independently of the jacks 15 and 20. For this purpose, in addition to the device 21 for accommodating excess fluid and delivering make-up fluid, an isolating valve 35 is provided which can be utilized to connect the delivery line 36 of a pump 37 to one end of the jack 16 and a return line 38 to the other. The valve 35 is provided with a second position of operation for crossing over these connections to the jack 16, as well as with its centralized, normal position of operation as shown, in which it directly connects the annular end of the jack 16 to the device 21 via the line 18, and isolates the pump delivery 36 and the return line 38 from the system.

Figure 7:
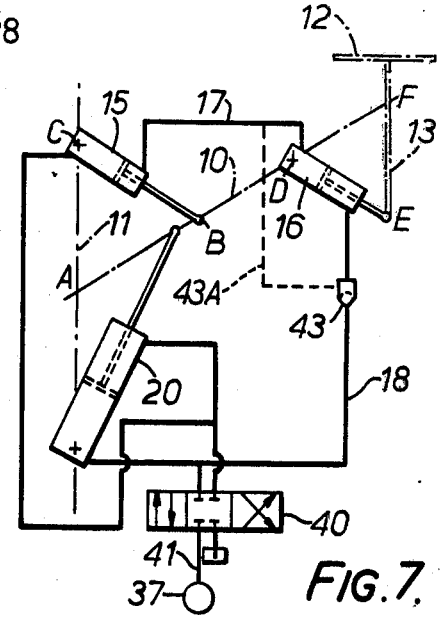

In the arrangement of FIG. 7 a selector valve 40 is provided which controls the operation of the lift jack 20. When in its position to actuate the lift jack 20 to elevate the jib, the valve 40 also connects the pump delivery line 41 to the annular end of the dump ram 16, via a pilot-operated non-return valve 43, whose pilot line is shown at 43A, thereby maintaining the pressure in the closed hydraulic link 17. The full-bore end of the jack 15 is then connected by the valve 40 to the return line, that this does not matter because the jack 15 is held in position by the jib 10. When the valve 40 is moved to its position to actuate the lift ram 20 in the direction to lower the jib, a positive pressure is maintained in the closed hydraulic link 17 by means of the pilot-operated check valve 43. This valve will only allow fluid flow in the reverse direction if there is a positive pilot signal present in the closed hydraulic link 17, thereby ensuring the maintenance of positive pressure in the link 17. In this arrangement live pressure is present in the full-bore end of the jack 15 but this has no significance in maintaining parallelism. That end of the jack 15 could equally well be vented to return line.

Any excess fluid displaced from the connection 18 when the jib is raised can escape through the valve 40 to the delivery circuit of the pump 37 and thence via the usual pressure relief valve (not shown) to the low-pressure return.

Figure 8:
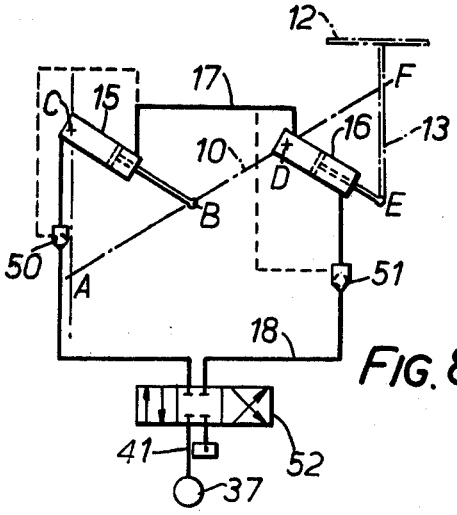

FIG. 8 shows another arrangement, in which the lifting jack 20 is dispensed with and the first jack 15 is used for lowering and raising the jib 10 as well as for the levelling function. As before, parallelism of the drill carriage is achieved by the connection of the annular end of each jack to the full-bore end of the other jack and by maintenance of positive pressure in the top hydraulic link 17, just as in the case of FIG. 2. In FIG. 8, however, two pilot-operated check valves 50, 51 are provided in the hydraulic link 18, both operated by pilot connections to the other link 17, to maintain a positive pressure therein, and the valve 52 enables pressure and return connections to be made in either sense to the jacks 15 and 16 for raising or lowering the jib.

The energy required by the jack 15 for raising the jib is derived from the fluid supplied under pressure to the jack 16. Thus, when the valve 52 is moved from its neutral position to the left it connects supply pressure from the pump 37 to the annular end of the jack 16, thus contracting the jack 16 to displace fluid through the closed connection 17 into the annular end of the jack 15 and contracting the jack 15 to raise the jib, the contraction of jack 16 at the same time maintaining parallelism of the carriage 12. When the valve 57 is moved towards the right, the supply pressure is connected to the full-bore end of the jack 15 to expand that jack and lower the jib, parallelism of the carriage 12 being maintained through the action of the closed connection 17 and jack 16.

As in the case of FIG. 7, excess fluid displaced by the raising of the jib in FIG. 8 can escape via the valve 52, either back to the pump 37 and hence to tank via the usual pressure relief valve in the pump circuit when the valve 52 is in one of its two operative positions, or, if the valve is in its second operative position, directly to the tank. No special device for accommodating excess fluid is required in the arrangement of FIG. 7, or that of FIG. 8.

It will be appreciated that in the embodiments specifically described above, the triangles CAB and EFD (or DFE), have been similar triangles whose ratio of similarity depended on the relative sizes of the two jacks 15 and 16. It would, however, be possible in every case to employ a geometry providing equal triangles CAB and EFD (or DFE), i.e. a ratio of similarity equal to unity, provided that the relative sizes of the jacks 15 and 16 can be appropriately adapted to meet the condition that the annular area of the jack 15 equals the full-bore area of the jack 16.

FIGS. 1 to 8 show the geometry of the control system in very simplified forms, i.e. with the pivot points A and B to the jib lying on the same line as the pivot points D and F. This is not necessary, and there is a great deal of scope for the designer to locate the positions of the pivots of the jacks to the jib in the most convenient places, as in the practical examples shown in FIGS. 9 to 13 described below.

Moreover, it will be understood that as described above with reference to FIGS. 1 to 8, the systems of levelling jacks 15 and 16 and their interconnections provide control of the orientation of the drill carriage about a horizontal pivotal axis only. To provide control of orientation about a vertical pivotal axis through point F, a second levelling system would usually be provided consisting of two further levelling jacks operating in horizontal planes and interconnected hydraulically, with (if necessary) a device 21 in one of the interconnections, the jacks forming sides of respective similar horizontal triangles just as in the case of the levelling systems described and illustrated which operate in a vertical plane. With two such levelling systems provided to control the drill carriage into strict parallelism for both lifting and slewing movements of the jib, it is possible to drill a set of horizontal or near-horizontal holes which are spaced apart horizontally as well as vertically and whose longitudinal axes are all strictly parallel.

To adjust the orientation of the carriage about either the horizontal or the vertical pivot axis through F, use may be made of the appropriate jack 16 as a dump ram, additional fluid being introduced into the hydraulic circuit or fluid being discharged from it by appropriate means to actuate the jack 16, for example as described above in connection with certain of the illustrated arrangements.

Figure 9:
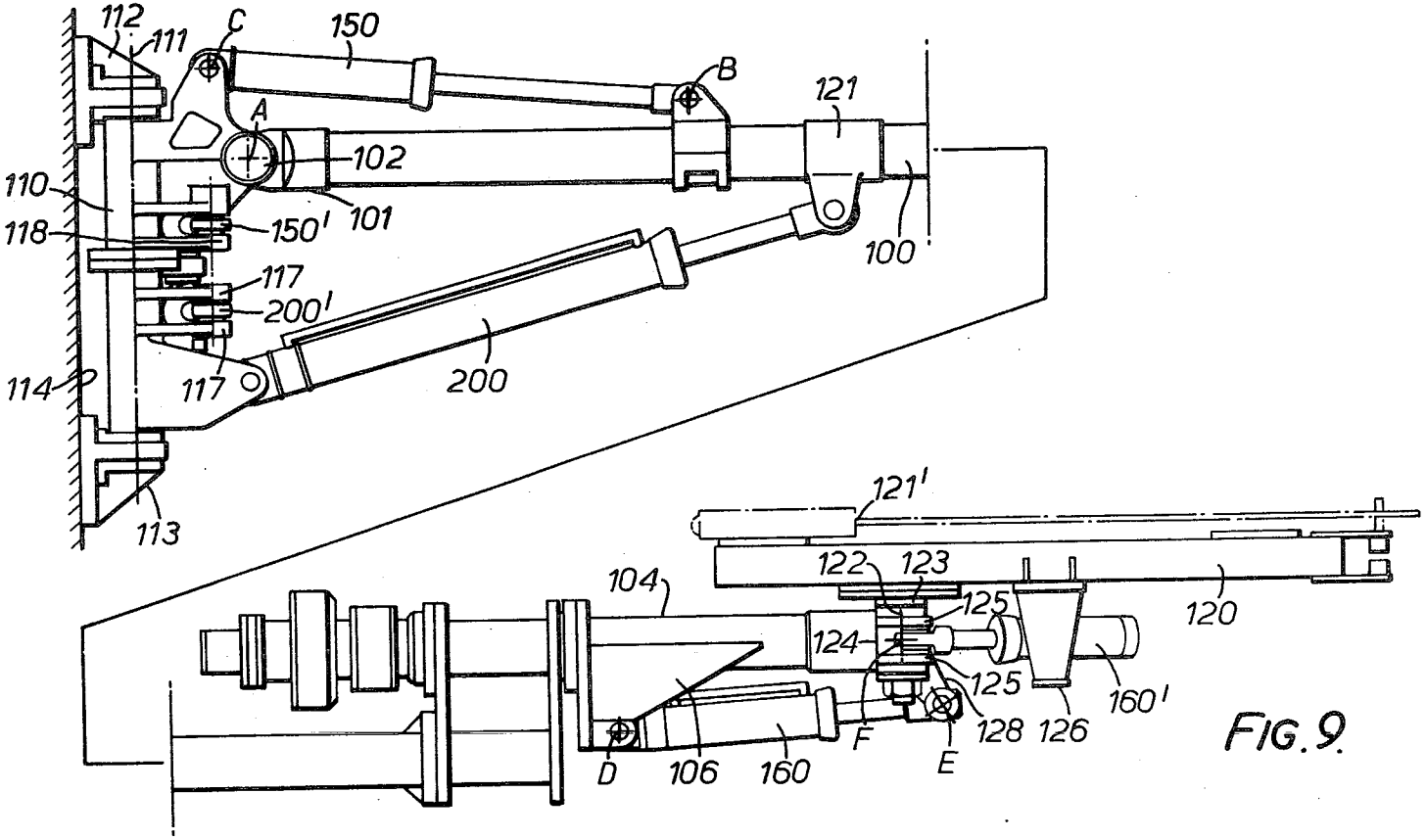
FIGS. 9 and 10 show, respectively in elevation and plan, one practical construction of drilling machine embodying hydraulic levelling systems corresponding broadly to that of FIG. 7 and respectively controlling the drill carriage during lifting and slewing of the jib.
Figure 10:
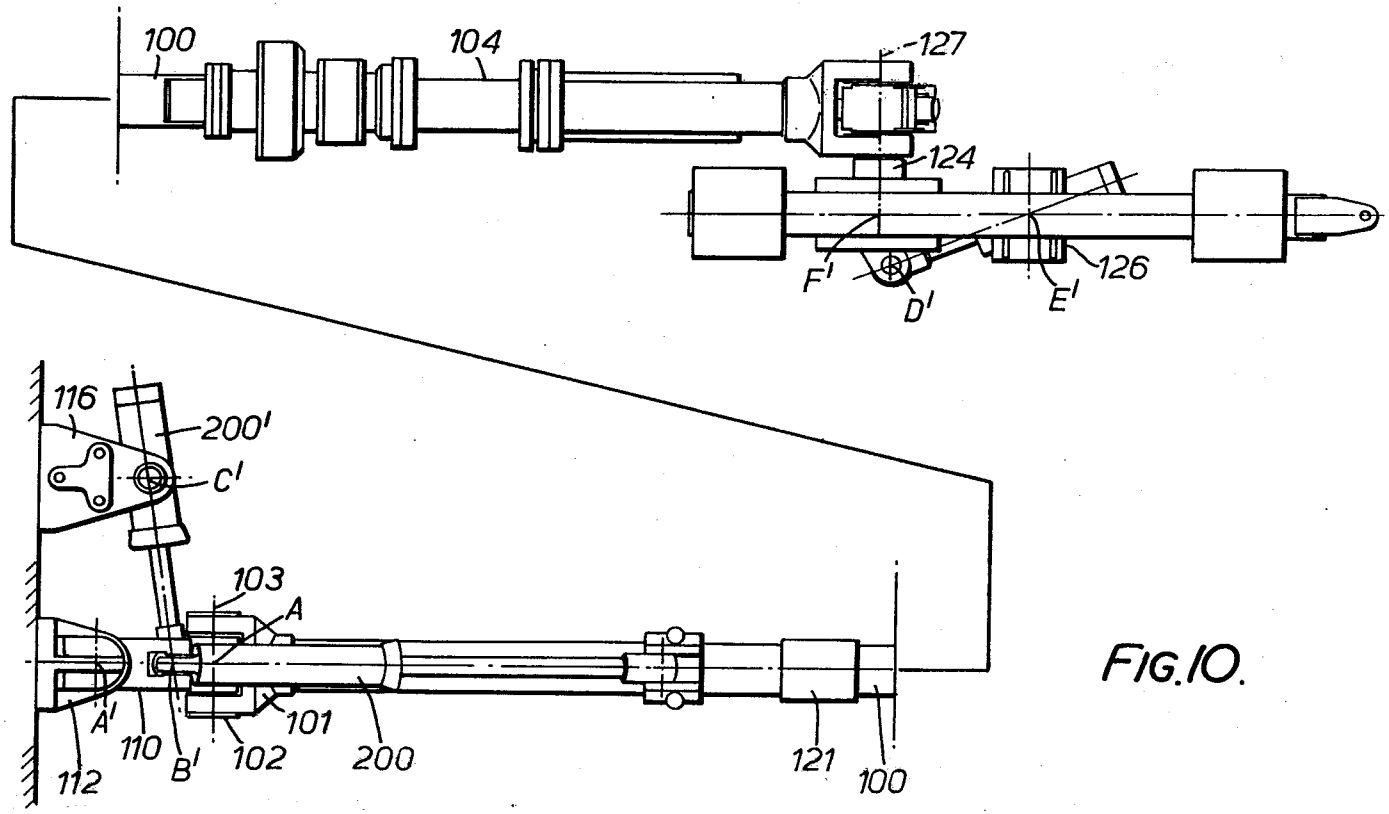

FIGS. 9 and 10 show a practical construction of drilling machine for mounting on a vehicle, e.g. a crawler tractor, the machine having hydraulic control systems of the kind described with reference to FIG. 7 for controlling the parallelism of the drill carriage. The machine comprises a rigid jib 100 having a yoke 101 fixed to its lower end by means of which it is pivoted to a slewing bracket 110, by a pivot pin 102 whose centre A lies on the horizontal pivot axis 103 of the pin 102.

The slewing bracket 110 is itself pivoted about a vertical axis 111 through the point A′ in FIG. 10 to a pair of mounting brackets 112, 113 which can be rigidly bolted to the frame 114 of the supporting vehicle (not shown) to support the whole drilling machine in the vehicle.

Thus the jib can swing up and down in a vertical plane about the horizontal pivotal axis 103 at its lower end, and can be slewed from side to side about the vertical slewing axis 111. A lifting jack 200 is provided for lifting the jib up and down about the horizontal pivot axis 103, the jack 200 acting between the slewing bracket 110 and a collar 121 fixed on the jib 100. For slewing the jib about the axis 111, a slewing jack 200′ is provided which acts between fixed anchorage 116 on the vehicle frame 114 and a pair of spaced arms 117 of the slewing bracket 110.

At its outer end the jib 100 carries a raised, telescopic extension 104, on which the drill carriage 120 is pivotally mounted. A pneumatic rock drill and bit can be mounted longitudinally on top of the drill carriage 120 to be supported by the carriage for a drilling operation, as shown in broken lines at 121′ in FIG. 9. The drill carriage 120 incorporates a "crowd ram" (now shown) which slides the carriage 120 forwards relative to the arm 124 so as to bring the leading part of the carriage 120 close to the surface to be drilled. The carriage 120 incorporates a feed device (not shown) for progressively feeding the drill and bit forwards relatively to the carriage into the hole being drilled during a drilling operation.

The drill carriage 120 is pivotally mounted for swinging movement about a vertical pivot axis 122 through point F′ by means of a spindle 123 journalled in an arm 124 projecting laterally from the jib extension 104. A swing jack 160′ is pivoted at D′ to lugs 125 of the arms 124, and pivoted at E′ to a bracket 126 depending from the drill carriage 120, and controls the swinging of the drill carriage relative to the jib about the vertical axis 122. The arm 124 is itself pivoted to the leading end of the jib extension 104 about a horizontal axis 127 passing through point F, and a dump jack 160 is pivoted at D to a bracket depending from the jib extension 104, and at E to a lug 128 projecting from the pivoted arms 124. The dump jack 160 thus controls the angle of tilt of the drill carriage 120 and drill 121 relative to the jib 100 and its extension 104 both for parallelism and for "dumping" purposes.

A slave jack 150 is pivoted about horizontal axes at opposite ends, respectively at C to the slewing bracket 110 and at B to a collar 151 on the jib 100, and senses the angle of inclination of the jib relative to the slewing bracket. The triangles ABC and FDE in FIG. 9 lying in vertical planes correspond to the same triangles in FIG. 7 and are similar triangles, the angle CAB being normally held equal to the angle DFE.

A second slave jack 150′ is pivoted about vertical axes at opposite ends, respectively to arms 118 of the slewing bracket 110 about an axis through point B′ in FIG. 10, and to the anchorage 116 on the frame 114 about an axis through the point C′ in FIG. 10. The slave jack 150′ lies immediately below and parallel to the slewing jack 200′, and senses the angle of slew of the slewing bracket 110 and jib 100 relative to the frame 114 about the vertical slewing axis 111. The triangles A′B′C′ and F′D′E′ in FIG. 10 lie in horizontal planes and are similar triangles, equivalent to the triangles ABC and FDE in FIG. 7, and the angles C′A′B′ and D′F′E′ are equal.

Figure 11:
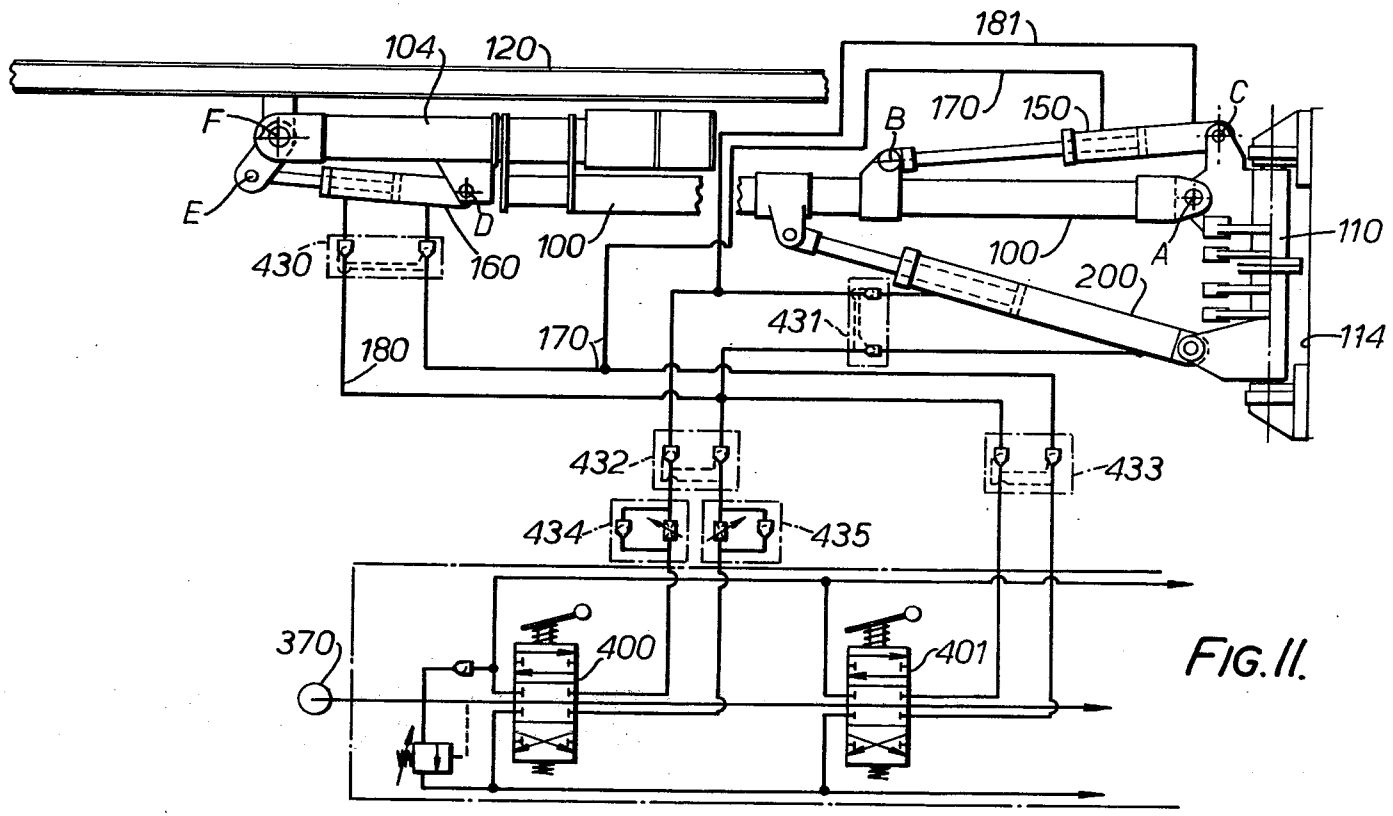
FIGS. 11 and 12 are, respectively, diagrams showing the hydraulic circuits of the lifting and slewing control systems of the machine of FIGS. 9 and 10.
Figure 12:
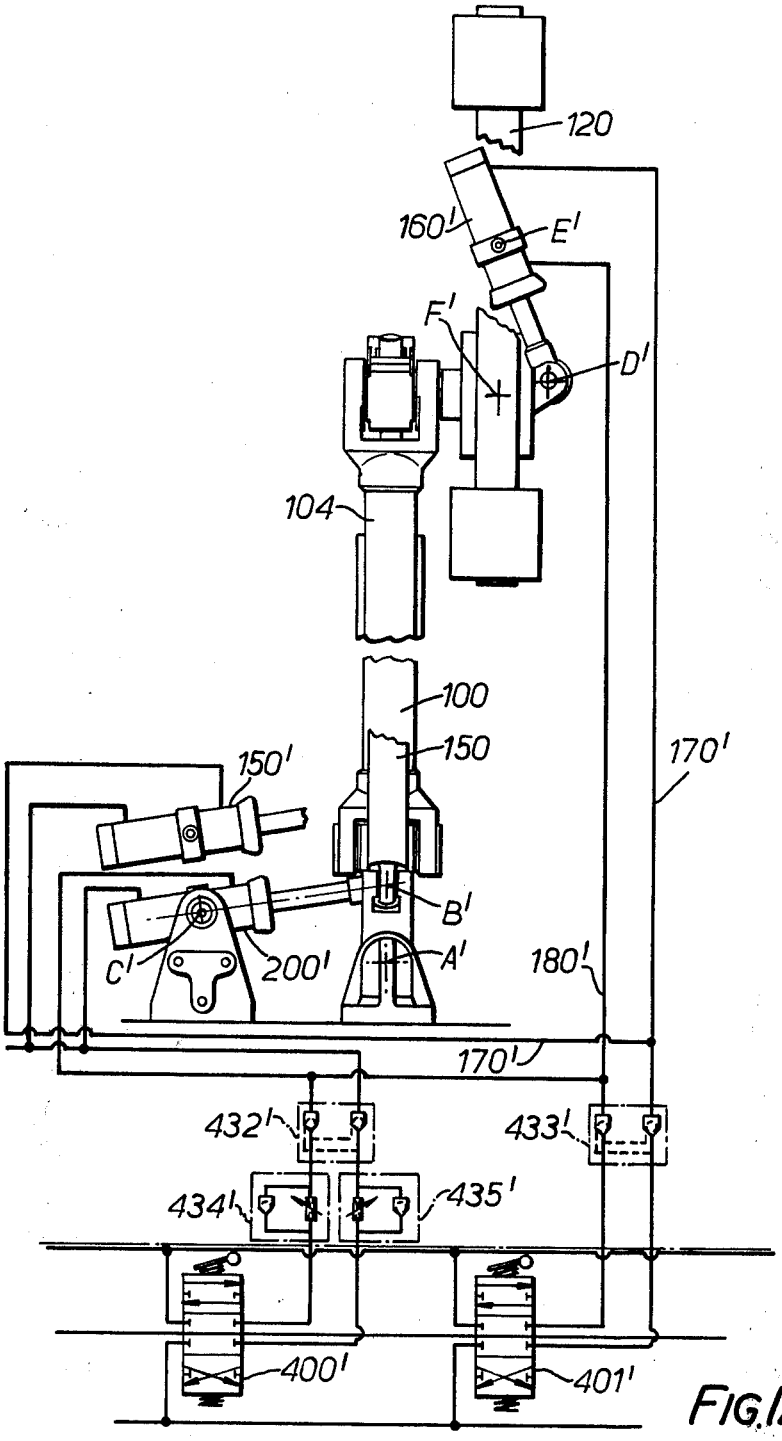

FIGS. 11 and 12 show the hydraulic interconnections and circuit diagrams of the respective lifting and slewing control systems.

FIG. 11 shows the jib lifting control circuit. The full-bore end of the dump jack 160 is connected by a closed hydraulic pipeline 170 to the annular end of the slave jack 150, and the annular end of the dump jack 160 is connected to the full-bore end of the slave jack 150 through a hydraulic circuit which includes a "lift and auto-dump" selector valve 400 in parallel with an alternative, "manual-dump" selector valve 401. The valve 400 which is provided with a pressure relief valve 402 corresponds to the valve 40 of FIG. 7, and also controls the operation of the lift jack 200. When the valve 400 is moved out of its neutral position as shown, into its cross-over position (upwardly as shown in FIG. 11) it connects the fluid pressure from the supply pump 370 to the full-bore end of the lift jack 200 to raise the jib 100, and at the same time connects the supply pressure to the annular end of the dump jack 160 via the double pilot-operated check valve 430, thereby maintaining positive pressure in the closed hydraulic link via the dump jack 160. The upward movement of the jib 100 by the lift jack 200 contracts the slave jack 150 thereby drawing fluid via the closed hydraulic link 170 from the full-bore end of the dump jack 160 via the check valve 430 held open by the pressure in the connection 180 to the annular end of the jack 160. The jack 160 therefore contracts to tilt the drill carriage in the sense to maintain parallelism as the jib lifts. The fluid expelled from the slave jack 150 passes through the line 181 back to the valves 400, 402 and thence to the system return line. When the valve 400 is operated in the direction to lower the jib, i.e. is moved into its straight-through position, it causes the contraction of the lift jack 200, and the closed hydraulic connection 17 between the jacks 150 and 160 operates in reverse to contract the dump jack 160 as the slave jack 150 is extended, a positive pressure being maintained in the hydraulic link 170 by the supply pressure connected to the full-bore end of the slave jack 150 and by the pilot-controlled check valve 430 which will only allow fluid flow from the annular end of the dump jack so long as there is positive pressure in the connection 170. Make-up fluid is delivered into the line 180 from the full-bore end of the lift jack 200.

As explained, the dimensional proportions of the respective cross-sectional areas of the full-bore and annular ends of the jacks 160 and 150 respectively are chosen so that the ratio of the linear displacements of the jacks 160 and 150, i.e. the movements of their plungers relative to their casings under the control of the closed hydraulic link 170, is equal to the ratio of similarity of the triangles FDE and ABC, whereby as the jib is lifted and lowered by the lift jack 200 under the control of the selector valve 400, the drill carriage 120 is maintained in strict parallelism throughout such movements.

When the manual dump valve 401 is moved out of its neutral position as shown downwardly into its straight-through position, it connects the supply pressure to the annular end of the dump jack 160 and connects the hydraulic link 170 to return, and since the slave jack 150 is held motionless by the stationary jib 100, the dump jack 160 contracts and tilts the drill carriage downwardly. When the dump valve is reversed through neutral into its upper, cross-over position it reverses the fluid connections to the dump jack 160 and thus enables this jack to return to its normal working condition in which the triangles ABC and FDE are similar.

As shown, the lift jack 200 like the dump jack 160 is provided with built-in double pilot-operated check valves 431 to ensure the maintenance of positive hydraulic pressure in the working chambers on opposite sides of the jack piston. These pairs of check valves 430 and 431 serve the same purpose as the valve 43 of FIG. 7.

There are also in the circuit, two other pairs of pilot-operated check valves 432 and 433 and also two one-way restrictor valves 434, 435. These extra valves play no direct part in maintaining the parallelism of the drill carriage 120, the check valves 432 and 433 are to prevent unnecessary leakage across the spools of the selector valves, and the restrictor valves 434 and 435 are to control the rate of movement of the system.

FIG. 12 is a diagrammatic plan view showing the arrangement of the slew jack 200' and the swing and slave jacks 160' and 150', and also the hydraulic circuit utilized for maintaining parallelism of the drill carriage 120 during slewing of the jib about the vertical axis through A'. In FIG. 12 parts of the slew control circuit which correspond to similar parts in the left control circuit shown in FIG. 11 are given the same reference numerals but distinguished by a dash. The arrangement and mode of operation of the slew control system of FIG. 12 correspond exactly with those of the lift control system of FIG. 11, and will not be further described. In FIG. 12 the slave jack 150' is shown offset from the slew jack 200', for clarity, although in practice it is situated immediately above the slew jack 200' as shown in FIGS. 9 and 10, and the pilot-operated check valves built in to the jacks 160' and 200' (corresponding to the valves 430 and 431 of FIG. 11) are not shown in the drawing.

Figure 13:
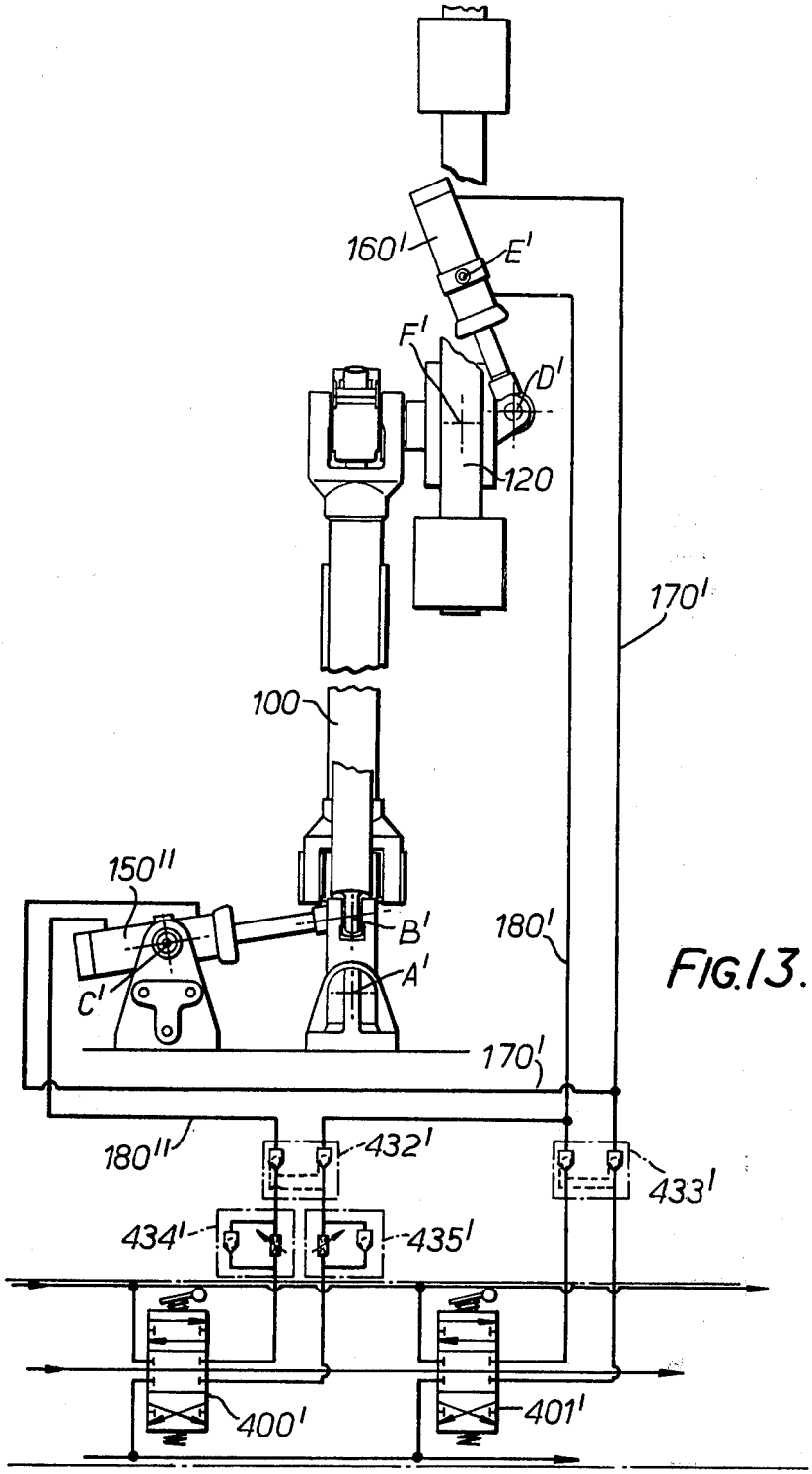
FIG. 13 is a diagram similar to FIG. 12 but showing a modified construction of slewing control for the drilling machine, similar to that of FIG. 8.

FIG. 13 shows a modified arrangement of the slewing system for the drilling machine of FIGS. 9 and 11, which retains the lifting system shown in FIG. 11 but uses a slewing system corresponding to that of FIG. 8, one jack being employed both as the slew jack and as the slave jack. Thus in FIG. 13 the single jack 150'' serves both to slew the jib 100 about the vertical axis A' and to sense the angle of slew, i.e. the angle C'A'B'. As before, the annular end of the jack 150'' is connected by a closed hydraulic link 170'' to the full-bore end of the swing jack 160''. The jacks 150'' and 160'' have built-in double pilot-operated check valves (not shown) similar to the valves 430, 431 of FIG. 9. The parallelism of the drill carriage 120 is maintained by the interconnected jack 150'' and 160' and by the maintenance of positive hydraulic pressure in the closed hydraulic link 170' as before. When the slew and auto-swing valve 400' is moved downwardly from its neutral position to supply pressure to the full-bore end of the jack 150'' and expand the jack 150'' to slew the jib in the clockwise direction, as seen in FIG. 13, fluid displaced from the annular end of the jack 150'' will be transmitted via the closed hydraulic link 170' to the full-bore end of the swing jack 160' as before to maintain parallelism of the drill carriage 120. Fluid is displaced from the annular end of the swing jack 160' into the connection 180'. Conversely, the movement of the valve 400' to its upper position connects the annular end of the swing jack 160' to pressure to expand the swing jack 160'. Fluid is displaced through the closed connection 170' into the annular end of the jack 150'' to contract that jack and slew the jib in the anti-clockwise direction in FIG. 13, parallelism being maintained by the contraction of the swing jack 160'. The manual swing valve 401' operates in the same manner as in the arrangement of FIG. 12 to enable the drill carriage to be swung deliberately out of parallelism and returned to parallelism, when required.

In the arrangements of FIGS. 12 and 13, any excess liquid displaced into the connection 180' or 180'' on swinging of the jib can escape via the pilot-operated check valves 432' and the valve 400' to return as before, positive pressure being maintained in the connection 180' or 180'' by the check valves 432' and in the closed connection 170' by the pilot-operated check valves built into the jacks 160' and 200' or 150''. Thus no special device is required for accommodating excess fluid displaced by the raising or slewing of the jib in any of the control circuits shown in FIGS. 11 to 13.

The arrangement of FIG. 13 uses only two jacks, which is obviously simpler and less expensive than that of FIGS. 11 and 12 which requires three jacks in each of the lift and slew control systems. However the three-jack arrangement of FIGS. 11 and 12 may be preferred as giving greater stiffness and enabling greater thrusts to be generated for a given system pressure when one of the jacks does not have to provide both thrust for lifting or slewing and also control pressure to the dump or swing jack. The force which the structure has to withstand are usually greater in the drilling condition than when it is being moved to a new hole position. In the static condition the parallelism function is not operating and all three jacks of each control circuit help to resist external forces applied to the structure.

It will be appreciated that in each of the arrangements of FIGS. 9 to 13, when the valve 401 or 401' is operated to tilt or slew the carriage 120 independently of movement of the jib, this disturbs the parallelism of the carriage and destroys the similarity of the triangles CAB, DFE. To restore the mechanism to its original condition for operation with parallelism maintained as the jib tilts or slews, the operator must return the carriage to its original "parallel" orientation in which the triangles are once more similar. He can do this by manipulation of the valve 401, or 401', restoring parallelism by eye and/or with the aid of some simple indicator device.

What we claim as our invention and desire to secure by Letters Patent is:

1. A supporting mechanism for a support seat which is capable of controlling the orientation thereof, the mechanism comprising a jib having an inner end and an outer end, the inner end being pivotally connected along a first pivot axis to a support structure;

a support seat pivotally mounted onto said outer end of said jib, said support seat being pivotable about a second axis, said second axis being parallel to said first pivot axis;

a first hydraulic, linearly expandable and contractible jack, said first jack being pivotally connected at one end to said support structure and at the other end to said jib and capable of sensing angular movement of said jib relative to said support structure about said first pivot axis, said first jack having a closed full-bore end and an annular end;

a second hydraulic, linearly expandable and contractible jack, said second jack being pivotally connected at one end to said jib and at the other end to said support seat and capable of controlling the orientation of said support seat about said second axis, said second jack having a closed full-bore end and an annular end;

said first and second hydraulic, linearly expandable and contractible jacks being so constructed and arranged that in all angular positions of said jib a first triangle whose corners are respectively constituted by the pivotal connection point of said first jack to said support structure, the pivotal connection point of said jib to said support structure and the pivotal connection point of said first jack to said jib, is similar to but different in linear dimensions from a second triangle whose corners are respectively constituted by the pivotal connection point of said second jack to said support seat, the pivotal connection point of said jib to said support seat, and the pivotal connection point of said second jack to said jib, said first and second jacks lying in corresponding sides of said similar triangles;

first hydraulic connection means connecting said full-bore end of one of said first or second jacks with the annular end of the second of said first or second jacks, said first hydraulic connection means comprising a hydraulic connection of fixed volumetric capacity between said full-bore end and said annular end such that the displacement of a volume of a fluid from one of said first and second jacks into said connection on contraction of said one jack displaces an equal volume of fluid from said connection into the other of said jacks;

means for maintaining said first hydraulic connection means under positive hydraulic pressure; and wherein each of said annular ends of said first and second jacks are smaller in effective cross-sectional area than said respective full-bore ends, and wherein the ratio of effective cross-sectional areas of said ends of said first and second jacks connected by said first hydraulic connection means is equal to the ratio of similarity of said second and first triangles, respectively, and such that on pivotal movement of said jib relative to said support structure, the ratio of corresponding changes in operative length of said first and second jacks equals the ratio of similarity of said first and second triangles, respectively, whereby said support seat is maintained in parallel orientation throughout said pivotal movement of said jib.

2. A supporting mechanism as claimed in claim 1 in which the jib is mounted for pivotal movement about each of two mutually-transverse pivotal axes at or near its inner end, and the supported member is pivotally mounted on the outer end of the jib for pivotal movement about each of two mutually-transverse pivotal axes respectively parallel to the said pivotal axes of the jib, and which is provided with two of the said hydraulic levelling systems which respectively control the parallelism of the supported member during pivotal movement of the jib about its respective pivotal axes.

3. The supporting mechanism of claim 1 including a pressure fluid supply means, a delivery conduit for delivery of fluid from said pressure fluid supply means to one of said ends of said second jack, a return conduit connected the second of said ends of said second jack, and a control valve connected in said delivery conduit, said control valve operating to control said second jack and thus control rotation of said support seat relative to said jib without maintaining parallelism.

4. A supporting mechanism as claimed in claim 3, which includes a second control valve operable independently of the first valve and selectively movable from a neutral position into either of two operating positions in which it respectively connects the full-bore end of the second jack to the pump delivery circuit and the annular end of the second jack to a low-pressure return, or vice versa, whereby the second jack is energised to rotate the supported member in the corresponding direction without maintaining parallelism.

5. The supporting mechanism of claim 1 wherein each of said first and second jacks includes a hollow, enclosed jack cylinder, a jack plunger movable within said jack cylinder, a stem connected to one side of said jack plunger and extending through one end of said cylinder; said annular end of each said first and second jacks comprising the chamber formed by said cylinder, said plunger and said stem; and said full-bore end of each said first and second jacks comprising the chamber formed at the opposite side of said plunger between said plunger and said cylinder.

6. The supporting mechanism of claim 5 wherein said first hydraulic connection means connects said annular end of said first jack with said full-bore end of said second jack.

7. The supporting mechanism of claim 6 wherein said means for maintaining said first hydraulic connection means under positive hydraulic pressure comprises a second hydraulic connection means connecting said full-bore end of said first jack means with said annular end of said second jack, said second hydraulic connection means including a means for accomodating excess hydraulic fluid displaced from said full-bore end of said first jack upon pivotal movement of said jib.

8. The supporting mechanism of claim 7 wherein said means for accomodating excess displaced fluid comprises a hydraulic accumulator.

9. The supporting mechanism of claim 7 wherein said means for accomodating excess displaced fluid includes a hydraulic pump connected through a pressure-limiting valve to said second hydraulic connection means, said valve allowing for either discharge of fluid out of said second hydraulic connection means or delivery of fluid from said hydraulic pump into said second hydraulic connection means.

10. The supporting mechanism of claim 7 wherein said means for accomodating excess displaced fluid comprises a third hydraulic jack, said second hydraulic connection means being connected to opposite ends of said third hydraulic jack, and said opposite ends of said third hydraulic jack having different effective cross-sectional areas.

11. The support mechanism of claim 7 wherein said means for accomodating excess displaced fluid includes a hydraulic pump connected through a valve to said second hydraulic connection means, said valve being selectively operable to either prevent fluid flow through said hydraulic connection means, connect said first jack to hydraulic pump and said second jack to a fluid accumulator, or connect said second jack to said hydraulic pump and said first jack to a fluid accomulator, whereby said first jack can function to pivotally move said jib about said first pivot axis and at the same time parallelism of said support seat can be maintained by the action of said first hydraulic connection means.

12. The support mechanism of claim 11 wherein two pilot-operated check valves connected adjacent said first and second jacks respectively and connected to and responsive to the pressure in said first hydraulic connection means.

13. The supporting mechanism of claim 7 wherein a fourth hydraulic jack is pivotally connected at one end to said support structure and at the opposite end to said jib, said fourth hydraulic jack functioning to effect pivotal movement of said jib about said first pivot axis.

14. The supporting mechanism of claim 13 wherein said second hydraulic connection means is connected to the opposite ends of said fourth hydraulic jack, and wherein said means for accomodating excess displaced fluid includes a pressure fluid supply means, a delivery conduit for delivery of fluid from said fluid supply means to said second hydraulic connection means, a return conduit connected to said second hydraulic means, and a control valve connected in said delivery conduit and said return conduit which is operable to connect said fluid supply means with said fourth jack and cause it to pivot said jib in either direction and which is operable to discharge fluid out of said second hydraulic connection means.

15. The support mechanism of claim 14 wherein said means for maintaining said first hydraulic connection means under positive hydraulic pressure comprises said second hydraulic connection means, and wherein said second hydraulic connection means includes a pilot-operated check valve connected to and responsive to the pressure in said first hydraulic connection means.

* * * * *

UNITED STATES PATENT OFFICE
CERTIFICATE OF CORRECTION

PATENT NO. : 4,116,409
DATED : September 26, 1978
INVENTOR(S) : Anthony Dobson Barber et al It is certified that error appears in the above-identified patent and that said Letters Patent are hereby corrected as shown below:

[30] FOREIGN APPLICATION PRIORITY DATA

July 2, 1975 Great Britain.....27858/75

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*